US006838996B2

(12) United States Patent
Deimel

(10) Patent No.: US 6,838,996 B2
(45) Date of Patent: Jan. 4, 2005

(54) APPARATUS AND METHOD IMPROVING SAFETY IN THE OPERATION OF A CRANE

(76) Inventor: Walter Deimel, 7322 W. Bonnie Ave., #2, Kennewick, WA (US) 99336

( * ) Notice: Subject to any disclaimer, the term of this patent is extended or adjusted under 35 U.S.C. 154(b) by 0 days.

(21) Appl. No.: 10/329,211

(22) Filed: Dec. 24, 2002

(65) Prior Publication Data

US 2004/0119598 A1 Jun. 24, 2004

(51) Int. Cl.[7] ..... G08B 21/00
(52) U.S. Cl. ..... 340/685; 340/435; 340/825.72
(58) Field of Search ..... 340/435, 685, 340/473, 471, 468, 944, 286.11, 328, 825.69, 825.72; 212/276, 280, 281, 284, 285, 118, 127, 128, 124; 342/69, 70, 72, 118; 414/222.01, 222.02, 222.12; 367/226.05

(56) References Cited

U.S. PATENT DOCUMENTS 5,343,739 A 9/1994 Curry ..... 212/151
5,924,651 A 7/1999 Penza et al. ..... 246/124
6,140,930 A * 10/2000 Shaw ..... 340/685
6,208,260 B1 3/2001 West et al. ..... 340/691.3
6,476,763 B2 11/2002 Allen, Jr. ..... 342/357.1
6,480,098 B2 11/2002 Flick ..... 340/7.2
6,614,721 B2 * 9/2003 Bokhour ..... 367/128

* cited by examiner

*Primary Examiner*—Jeffery Hofsass
*Assistant Examiner*—Jennifer Stone
(74) *Attorney, Agent, or Firm*—Floyd E. Ivey; Liebler, Ivey, Connor, Berry & St. Hilaire

(57) ABSTRACT

The invention is an apparatus and method for improved safety in operation of a crane relative to the transit of a load overhead of workmen. A initiating operator transmits a RF signal to sound a first horn alarm when a lift commences. The initiating operator transmits a second RF signal, when the transit of the load commences, to sound a second horn alarm which operates asynchronously relative to the first horn alarm. A terminating operator disengages the horn alarms when the load is placed. Workmen will hear a Doppler effect as indicative of the direction of travel and position of the load.

6 Claims, 2 Drawing Sheets

APPARATUS AND METHOD IMPROVING SAFETY IN THE OPERATION OF A CRANE

FIELD OF THE INVENTION

The present invention relates generally to an apparatus and method for safe operation of a crane and, more particularly, to an alarm sounding apparatus and a method for crane operation where one or more alarms sound from commencement through completion of crane load transport.

BACKGROUND OF THE INVENTION

The transport of crane loads frequently requires passage of loads over workmen. Safety issues arise relative to inadvertent dislodging of load materials causing hazards to workmen within a drop zone. Warning and alarm devices used do not readily warn workmen regarding the position of the transiting load. Warning or safety apparatus and or methods are seen in the prior art including U.S. Pat. No. 5,343,739 to Curry; U.S. Pat. No. 5,924,651 to Penza et al; U.S. Pat. No. 6,140,930 to Shaw; U.S. Pat. No. 6,208,260 to West et al; and U.S. Pat. No. 6,476,763 to Allen, Jr. The recited patents are disclosed in an Information Disclosure Statement.

SUMMARY OF THE INVENTION

The invention disclosed herein is an apparatus and method for increased safety in the operation of a crane (1) during movement of load materials (32). An electronic circuit (70) is affixed to the crane boom, ball/hook, load and or other location at the crane. Upon commencement of the lift of a load (32), an initiating operator (40) operates a Remote Keyless Entry transmitter (80) via control switch (82) and transmits a RF signal (90) which is detected by a receiver or antenna (74), (75); a controller (71) controls the operation of an asynchronous alarm driver (72) which in turn operates an initial alarm of Horn Alarm #1 (77). Upon commencement of the transit of the load (32), the initiating operator (40) again operates the Remote Keyless Entry transmitter (80) via control switch (84) and transmits a second RF signal (92) which is detected by a receiver or antenna (74), (75) with the controller (71) controlling the operation of the asynchronous alarm driver (72) to provide at least a second output for the initiation of at least Horn Alarm . . . n (79). A load terminating operator (45) at the point where the load (32) is to be placed will operate a Remote Keyless Entry transmitter (80) via control switch (82), (84) and transmits RF signals (90), (92) which are detected by the receiver or antenna (74), (75) with the signal received by the controller (71) for the operation of the asynchronous alarm driver (72) which in turn operates to turn off the alarm of Horn Alarm #1 (77) and the alarm of Horn Alarm . . . n (79). The crane operator (47) will also have a transmitter (80) and may operate to activate the alarms or disengage the alarms.

DETAILED DESCRIPTION

Figure 1:
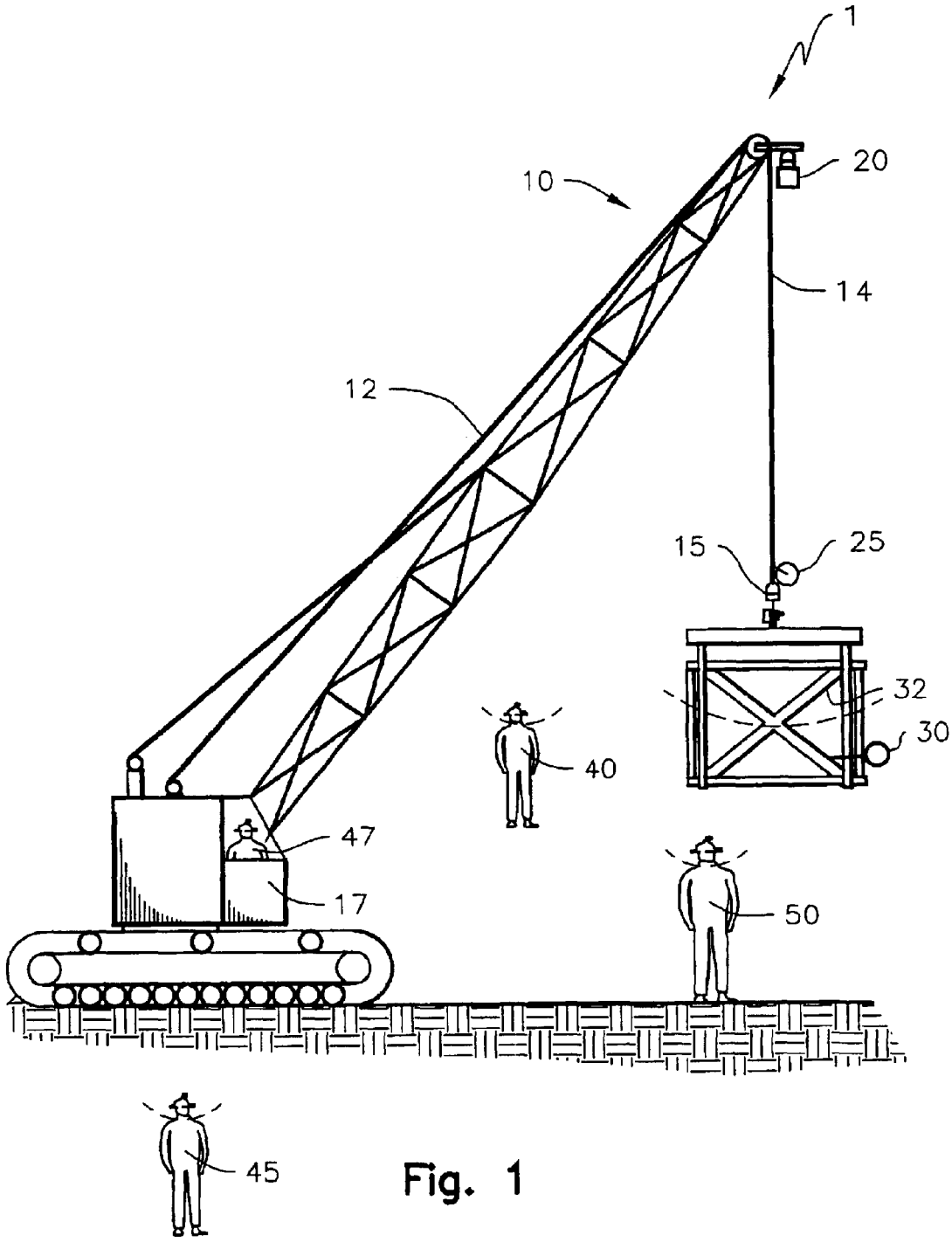
FIG. 1 depicts a crane (1) with a load (32). Alternative positions are demonstrated where the alarm electronic circuit (70) apparatus may be affixed including a top position (20), at the ball/hook position (25) and at the load position (30). Depicted are the initiating operator (40), the terminating operator (45) and the crane operator (47). The workman (50) to be attentive to the horn signals is depicted.
Figure 2:
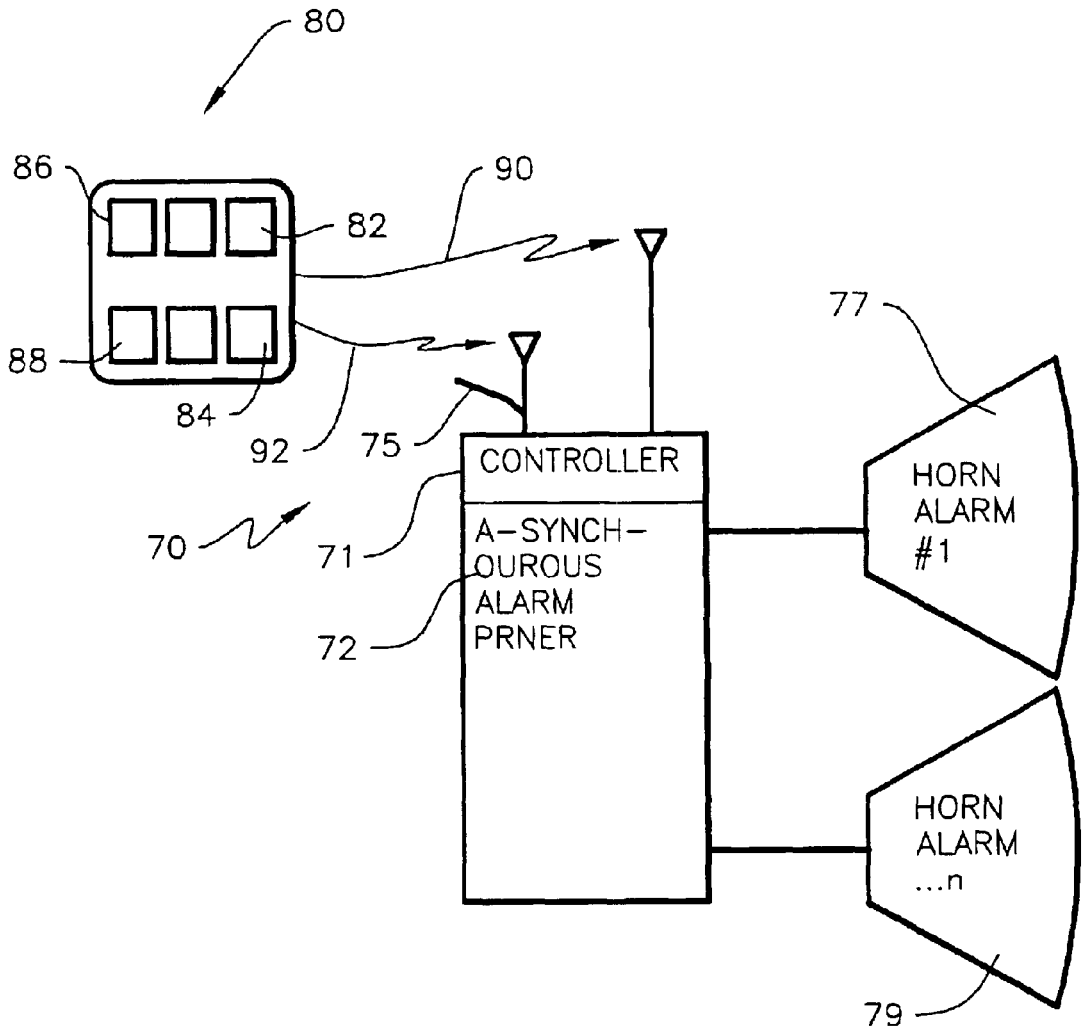
FIG. 2 depicts the electronic circuit (70) with transmitter (80), RF signals (90), (92) to detectors (74), (75); a controller (71) whose outputs is received by an asynchronous alarm driver which in turn provides power to Horn Alarm #1 (77) and Horn Alarm . . . n (79).

The invention disclosed herein is an apparatus and method for increased safety in the operation of a crane (1) during movement of load materials (32). A crane (1) typically includes a boom (10), various movement mechanisms (12) to move the boom (10) and/or cable (14) and ball/hook (15) in any one of a plurality of directions. The movement of load materials (32), affixed by load affixing means at the ball/hook (15), typically requires a load initiating operator (40) at the point where the load (32) commences its lift and transit, a load terminating operator (45) at the point where the load (32) to be placed and a crane operator (47) typically positioned in a crane cab (17). The load initiating operator (40) typically signals the crane operator (47) when the load (32) is ready to be transported. The crane operator (47) lifts the load (32) and transports to the termination point as directed by the terminating operator (45). The invention of this application is an apparatus and method where the apparatus comprises an electronic circuit (70) controlled as follows: first by the initiating operator (40) when the lift commences and when the load (32) is at transport height; second by the terminating operator (45) when the load (32) is at the termination point; and third by the crane operator (47) as needed.

The electronic circuit (70), in the preferred embodiment, is known to those in the alarm arts as a Remote Keyless Entry circuit initiated by a transmitter (80) transmitting at least a first radio frequency(RF) or code to be received by at least one receiver or antenna (74), (75). The transmission of an at least first RF signal (90) or code will be detected by a controller (71) and activate at least one Horn Alarm #1 (77). The transmission of a second RF signal (92) will be detected by a controller (71) and activate at least a Horn Alarm . . . n (79), which, in the preferred embodiment, will be activated asynchronously relative to the at least one Horn Alarm (77). The transmitter (80) is operated by control switches (82), (84), (86) and (88). In the preferred embodiment the transmitter will be capable of transmission of at least two RF signals or codes via control switches (82), (84). However additional RF signals or codes may be required and provided as demonstrated by control switches (86), (88).

In the preferred embodiment the initiating operator (40) will transmit a least one RF signal (90) when the load (32) lift commences. The detection by the controller (71) of the at least one RF signal (90) will commence operation, via an asynchronous alarm driver, of the at least Horn Alarm #1 (77). When the load (32) is at a height where the load (32) will be transported the initiating operator (40) will transmit the at least a second RF signal (92). The detection by the controller (71) of the at least second RF signal (92) will commence operation, via an asynchronous alarm driver (72), of the at least Horn Alarm . . . n (79). In the preferred embodiment the at least Horn Alarm #1(77) is a frequency which differs from that of the at least Horn Alarm . . . n (79). The electronic circuit (70) with controller (71) and asynchronous alarm driver (72) will be recognized by those in the electronic arts and may be composed of at least one RF detector, tuned to the frequency or code of the at least a first RF signal (90), whose output is received by the controller (71) which operates an asynchronous driver comprised, for example of a flip-flop array, with at least one output to a speaker driver providing power to at least Horn Alarm #1 (77); upon the transmission of at least a second RF signal (92), at least a second RF detector, tuned to the frequency or code of the at least a second RF signal (92), whose output is received by the controller (71) which operates an asynchronous driver comprised, for example of a flip-flop array, with at least a second output to a speaker driver providing power to at least Horn Alarm . . . n (79).

The preferred embodiment of the invention will provide an warning and safety signal of the at least Horn Alarm #1(77), comprised in the preferred embodiment of an intermittent horn, upon commencement of the lift of the load (32); in the preferred embodiment the single intermittent horn signal of at least Horn Alarm #1 (77) will be joined by an asynchronous horn signal of at least Horn Alarm . . . n (79), comprised of a frequency and tone differing from that of the at least Horn Alarm #1 (77). As the load (32) lift commences and transits from the commencement of the lift to the termination of the lift, those workmen in the vicinity and path of the load (32) transit will first hear the single at least first Horn Alarm #1 (77) and will know that a lift is commencing. The workmen will understand that a load (32) transit has commenced when the asynchronous at least first Horn Alarm #1 (77) tone is joined by the at least Horn Alarm . . . n (79) tone and will have a Doppler effect of the asynchronous horn alarms to assist in recognition of the direction from which the load (32) is approaching or transiting.

The electronic circuit (70) may be attached by attaching means at the boom (10) at top position (20), at the ball/hook position (25), at the load position (30) and at other locations as will be recognized by those of ordinary skill in the art. Attaching means for attaching the electronic circuit (70) includes any suitable method such as bolting, strapping, magnetic attachment and other methods as recognized by those of ordinary skill in the attaching arts.

I claim:

1. An apparatus for improved safety in the operation of a crane comprising:

A. an Remote Keyless Entry transmitter (80) capable of transmitting at least one RF signal(90) or code; an electronic circuit (70) affixed with affixing means proximal a crane load (32); the Remote Keyless Entry transmitter (80) remote from the crane load (32); the electronic circuit (70) comprised of RF or code receiving or detection means (74), (75), controller means (71) to receive the output of the RF or code receiving or detection means (74), (75); the controller (71) output operates an asynchronous alarm driver (72) which provides an output to operate at least a horn alarm (77).

2. The apparatus of claim 1 further comprising:

A. the transmitter (80) is capable of transmitting at least two RF signals or codes (90), (92); the electronic circuit controller (71) operates an asynchronous alarm driver (72) which provides outputs to operate at least a horn alarm alarm (77) and, upon transmission and detection of at least a second RF signal or code (92), outputs to operate asynchronously at least a plurality of horn alarms (79).

3. The apparatus of claim 2 further comprising:

A. the at least horn alarm (77) is a frequency which differs from that of the at least plurality of horn alarms (79).

4. A method for improved safety in the operation of a crane composed of the steps of:

A. affixing by affixing means an electronic circuit (70) proximal a crane load (32);

B. transmitting, from a position remote from the crane, at least a first RF or code (90) to be received by at least one receiver or antenna (74), (75) at the electronic circuit (70) upon commencement of crane operation;

C. detecting the at least first RF signal (90) or code by a controller (71) and activating at least one horn alarm (77).

5. The method of claim 4 further comprising the steps of:

A. transmitting the at least the first RF signal (90) or code upon commencement of lifting of a crane load (32);

B. transmitting, from a position remote from the crane, at least a second RF signal (92) or code upon commencement of transit of the crane load; detecting the at least second RF signal (92) or code by the controller (71) and activating at least a plurality of horn alarms (79);

C. transmitting, from a position remote from the crane, at least a first RF signal (90) and at least a second RF signal (92) or code upon termination of the crane lift thereby deactivating the at least the horn alarm (77) and the at least plurality of horn alarms (79).

6. The method of claim 5 further composing the steps of:

A. activating, by transmission from a remote from the crane, via an asynchronous alarm driver (72), the at least a first horn alarm (77) asynchronously relative to the at least plurality of horn alarms (79);

* * * * *